US009770834B2

(12) United States Patent
Wang

(10) Patent No.: US 9,770,834 B2
(45) Date of Patent: Sep. 26, 2017

(54) PLATE-TYPE UTILITY KNIFE

(71) Applicants: HANGZHOU GREAT STAR TOOLS CO., LTD., Hangzhou (CN); HANGZHOU GREAT STAR INDUSTRIAL CO., LTD, Hangzhou (CN)

(72) Inventor: Weiyi Wang, Hangzhou (CN)

(73) Assignees: Hangzhou Great Star Tools Co., Ltd, Hangzhou (CN); Hangzhou Great Star Industrial Co., Ltd, Hangzhou (CN)

( * ) Notice: Subject to any disclaimer, the term of this patent is extended or adjusted under 35 U.S.C. 154(b) by 0 days.

(21) Appl. No.: 14/369,999

(22) PCT Filed: Jan. 7, 2014

(86) PCT No.: PCT/CN2014/070214

§ 371 (c)(1),
(2) Date: Jun. 2, 2015

(87) PCT Pub. No.: WO2015/103725

PCT Pub. Date: Jul. 16, 2015

(65) Prior Publication Data

US 2016/0311121 A1 Oct. 27, 2016

(51) Int. Cl.
*B26B 5/00* (2006.01)
*B26B 1/08* (2006.01)

(52) U.S. Cl.
CPC ..... *B26B 5/001* (2013.01); *B26B 1/08* (2013.01); *B26B 5/00* (2013.01)

(58) Field of Classification Search
CPC ..... B26B 5/001; B26B 5/00; B26B 1/08
USPC ..... 30/162
See application file for complete search history.

(56) References Cited

U.S. PATENT DOCUMENTS 4,551,917 A * 11/1985 Walker ..... B26B 1/046 30/155
4,604,805 A 8/1986 Krieger
4,936,014 A * 6/1990 Shaanan ..... B26B 5/001 30/162

(Continued)

FOREIGN PATENT DOCUMENTS

CN 2685034 Y 3/2005
CN 101648383 A 2/2010

(Continued)

*Primary Examiner* — Hwei C Payer
(74) *Attorney, Agent, or Firm* — Seed IP Law Group LLP

(57) ABSTRACT

The present invention discloses a plate-type utility knife comprising a blade carrier, a blade structure and a cover plate, wherein, the blade structure is mounted on the front part of the blade carrier, between the blade carrier and the cover plate, the cover plate makes the blade structure fixed on the blade carrier. The blade carrier includes a main blade carrier plate and a front blade carrier plate, the front blade carrier plate is located in front of the main blade carrier plate, a vacancy that contains the blade structure is arranged on the front side of the main blade carrier plate, the blade structure is arranged in the vacancy, a space for containing the cover plate is arranged on the front side of the front blade carrier plate, the cover plate is mounted in the space. The blade carrier includes a back blade carrier plate, the main blade carrier plate is located between the front blade carrier plate and the back blade carrier plate.

23 Claims, 7 Drawing Sheets

(56) References Cited

U.S. PATENT DOCUMENTS 5,044,079 A * 9/1991 Gibbs ..... B26B 1/042 30/158
5,509,205 A 4/1996 Ragland, III
6,553,674 B1 4/2003 Budrow
6,951,055 B1 * 10/2005 Collins ..... B26B 1/048 30/125
7,007,392 B2 * 3/2006 Ping ..... B26B 5/00 30/155
7,121,005 B2 * 10/2006 Hughes ..... B26B 1/02 30/155
7,134,207 B2 * 11/2006 Ping ..... B26B 5/00 30/125
7,380,341 B2 * 6/2008 Ping ..... B26B 1/042 30/155
7,814,664 B2 * 10/2010 LeBlanc ..... B26B 1/042 30/156
8,006,389 B2 * 8/2011 Jennings ..... B26B 5/003 30/155
8,074,362 B2 * 12/2011 Gui ..... B26B 1/00 30/155
8,984,755 B2 * 3/2015 De ..... B26B 5/001 30/162
2005/0278955 A1 * 12/2005 Lee ..... B26B 5/00 30/153
2006/0026844 A1 * 2/2006 Ping ..... B26B 1/046 30/153
2007/0130777 A1 * 6/2007 Ping ..... B26B 1/046 30/155
2011/0271531 A1 11/2011 Huang
2012/0260505 A1 10/2012 Qiu
2014/0182140 A1 * 7/2014 Rosenhan ..... B26B 5/003 30/162
2016/0311121 A1 * 10/2016 Wang ..... B26B 5/001

FOREIGN PATENT DOCUMENTS

CN 101704250 A 5/2010
CN 101704251 A 5/2010
EP 3 093 110 A1 * 11/2016

* cited by examiner

PLATE-TYPE UTILITY KNIFE

FIELD OF THE INVENTION

The present invention is related to a knife, and more particularly to a plate-type knife. It is thin and easy to replace the blade.

DESCRIPTION OF THE PRIOR ART

For knives with replaceable blades, it is important to replace the blade safely and quickly, however, considering other factors such as thickness, problems might be brought for designing.

The common methods for replacing a blade makes the knife have a certain thickness. For example, the U.S. Pat. No. 6,553,674 discloses a utility knife, which can replace the blade automatically. The knife has an openable door at the side thereof, the blade replacement is accomplished by putting the stand-by blade in through the door and then closing the cover. The structure of side-opening door has many defects. For example, the door is connected to the housing of the knife via the pivot above the door; this would inevitably generate a certain width, making the knife thicker. Besides, since it is needed to maintain the close match between the openable door and the housing of the knife, ensuring the leakproofness of the knife, the gap between the pivot of the door and the housing of the knife should be as small as possible, in this case, the door can only be open to 90 degrees, making it difficult to place or take out the blade.

Therefore, utility knives with the blade being replaced conveniently and safely are still welcomed, especially utility knives with thin thickness.

SUMMARY OF THE INVENTION

The purpose of the present invention is to provide a plate-type utility knife with replaceable blade, the way of replacing the blade is safe and convenient, and the thickness of the knife can be maintained within a certain extent.

To realize the above purpose, the present invention provides a plate-type utility knife comprising a blade carrier, a blade structure and a cover plate, wherein, the blade structure is mounted on a front part of the blade carrier, between the blade carrier and the cover plate, and the cover plate can openably fix the blade structure on the blade carrier.

The blade carrier includes a main blade carrier plate and a front blade carrier plate, and the front blade carrier plate is located in front of the main blade carrier plate; a vacancy that contains the blade structure is arranged on a front side of the main blade carrier plate, and the blade structure is arranged in the vacancy; a space for containing the cover plate is arranged on a front side of the front blade carrier plate, and the cover plate is mounted in the space.

The blade carrier of the plate-type utility knife in the present invention includes a back blade carrier plate, the main blade carrier plate is located between the front blade carrier plate and the back blade carrier plate.

The main blade carrier plate, the front blade carrier plate, and the back blade carrier plate are respectively integrally-formed plate structure.

A protruding cover plate axis is arranged on the main blade carrier plate, the main blade carrier plate is connected with the cover plate via the cover plate axis, and the cover plate is rotatable around the cover plate axis.

The cover plate axis is arranged on the main blade carrier, at a lower edge of the blade structure, distal from the knife head.

In the first embodiment, the blade carrier has a lock catch extending to a surface of the cover plate.

The lock catch is above the blade carrier, and the lock catch is fixed on the blade carrier via a lock catch axis mounted on a upper edge of the blade carrier above the blade.

The lock catch is of a U-shaped channel structure, holes for installing the lock catch axis are arranged on lateral parts of the U-shaped channel, the lock catch is mounted on two sides of the blade carrier via the lock catch axis.

The width of the U-shaped channel is same as the blade carrier.

A protuberance or a recess is arranged on the side of the U-shaped channel, matched with the recess or the protuberance at the corresponding place on the cover plate.

The U-shaped channel has a handle that transversely extends from the side of the U-shaped channel at the bottom of the side of the U-shaped channel.

In the second embodiment, the upside of the cover plate extends to the upper edge of the main blade carrier above the blade structure, the part of the cover plate that is above the blade structure is defined as an extending part, and a hole is inside of the extending part; a fixing part is located at a place on the main blade carrier that is corresponding to the hole, the fixing part is connected to the main blade carrier plate and the fixing part has a protuberance, the protuberance is matched with the hole and reaches into the hole.

The blade carrier has a position restricting plate that is mounted at the outside of the extending part of the cover plate, making the extending part of the cover plate restrict in the position restricting plate.

The fixing part has a triggering part which is adjacent to the protuberance, the position restricting plate has a through-hole at a place that is corresponding to the triggering part, and the triggering part extends to the outside of the through-hole; the fixing part has a spring element arranged on the other side of the protuberance and the triggering part, and the spring element extends to the channel on the main blade carrier which is at the place corresponding to the fixing part.

In the first embodiment, the blade structure is a blade, the blade has notches on the back thereof, and the main blade carrier has integrally-formed protuberances at the place corresponding to the notches of the blade, capable of being clamped in the notches.

In the second embodiment, wherein, the blade structure is comprised of, a sliding blade carrier that can move forward and backward along the blade carrier, a sliding control element that extends from the top of the sliding blade carrier to the upside of the outside of the main blade carrier, and a blade which is mounted on the sliding blade carrier, thus, the extending and retracting of the blade carrier and the blade can be controlled by moving the sliding control element.

The blade has notches on the back thereof, and the sliding blade carrier has protuberances at a place corresponding to the notches of the blade, for fixing the blade.

The sliding control element has a grip region and a control rod, the grip region is above the blade carrier and the control rod extends from the grip region down to the sliding blade carrier, the sliding blade carrier has a receiving recess for receiving the control rod of the sliding control element.

A spring is arranged between a lower part of the control rod and the receiving recess of the sliding blade carrier, the lower part of the control rod is a lateral protuberance towards the main blade carrier plate, the lateral protuberance is corresponding to a upper part of the control rod, and spaced recesses are arranged at a corresponding place of the main blade carrier plate.

Except for the rotatable structure of the cover plate in the first embodiment and the second embodiment, the cover plate and the blade carrier can be connected by screw fastening, or in a snap-fit way.

A overall thickness of the plate-type utility knife in the present invention is greater than 1 mm and less than 10 mm.

Further, the overall thickness of the plate-type utility knife is greater than or equals to 3 mm and less than or equals to 7 mm.

Preferably, the overall thickness of the plate-type utility knife is 5 mm.

Referencing now to the figures, the conception, detailed structure and induced technical effects of the present invention will be expounded for due understanding of the purpose, characterizations and effects of the present invention.

DETAILED DESCRIPTION OF THE PREFERRED EMBODIMENTS

Figure 1:
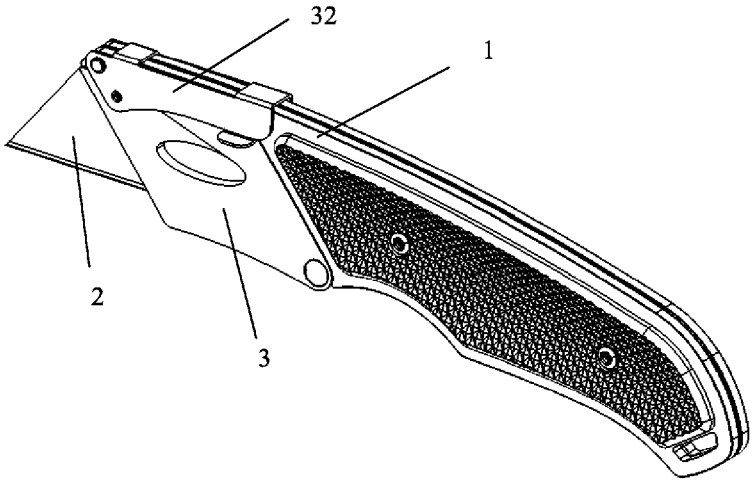
FIG. 1 is a perspective view of the first embodiment of the present invention.
Figure 2:
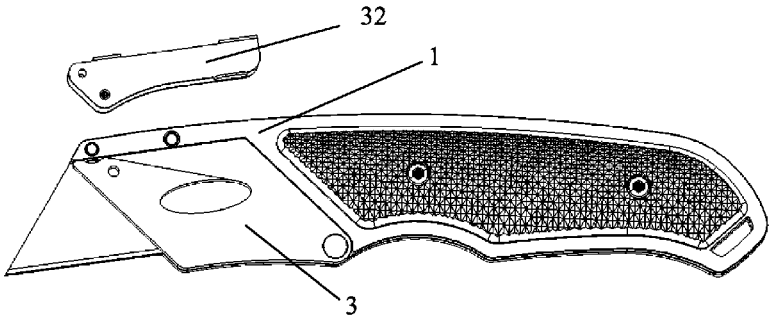
FIG. 2 is a first explosive view of the first embodiment of the present invention.

As shown in FIGS. 1 to 11, to realize the above purpose, the present invention provides a plate-type utility knife comprising a blade carrier 1, a blade structure 2 and a cover plate 3, wherein, the blade structure 2 is mounted on the front part of the blade carrier 1, between the blade carrier 1 and the cover plate 3, the cover plate 3 can openably fix the blade structure 2 on the blade carrier 1.

Wherein, the blade carrier 1 includes a main blade carrier plate 11 and a front blade carrier plate 12, the front blade carrier plate is located in front of the main blade carrier plate, and clings closely to the main blade carrier plate. A vacancy 111 that contains the blade structure 2 is arranged on the front side of the main blade carrier plate 11, the blade structure is arranged in the vacancy, a space 121 for containing the cover plate 3 is arranged on the front side of the front blade carrier plate 12, and the cover plate is mounted in the space. When the cover plate is mounted, the blade in the blade structure is impacted under the cover plate, so that the utility knife can be used stably. The blade carrier further includes a back blade carrier 13. In the circumstance that the blade carrier has a back blade carrier plate, the main blade carrier plate 11 is located between the front blade carrier plate and the back blade carrier plate. In this way, the blade structure is clamped in between the back blade carrier and the cover plate.

More specifically, the thickness of the vacancy is about the same as the thickness of the blade structure, the thickness of the space is about the same as the thickness of the cover plate, in this way, the utility knife is of a plate-type structure as a whole. Further, the area behind the blade structure of the utility knife, i.e. the handle, a shell plate 4 is mounted in front of the front blade carrier and behind the back blade carrier, of which the surface is designed to be rough, which is convenient for holding.

Wherein, the main blade carrier plate, the front blade carrier plate, and the back blade carrier plate are respectively integrally-formed plate structure, in order to reduce the overall thickness of the knife, which is convenient for processing. Besides, the main blade carrier plate, the front blade carrier plate, and the back blade carrier at the handle all have a hollow-out design, with solid entities only in the fixed-connecting part, to reduce the overall weight of the utility knife.

Figure 3:
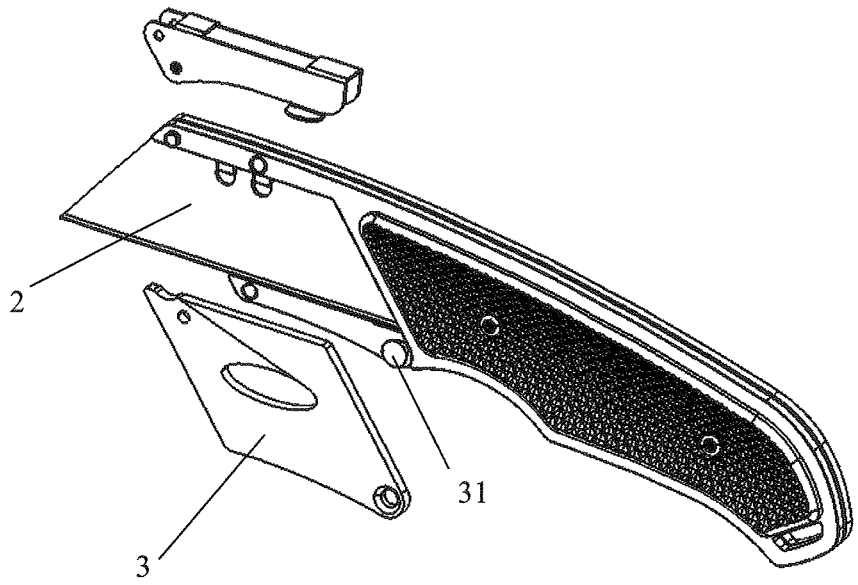
FIG. 3 is a second explosive view of the first embodiment of the present invention.
Figure 4:
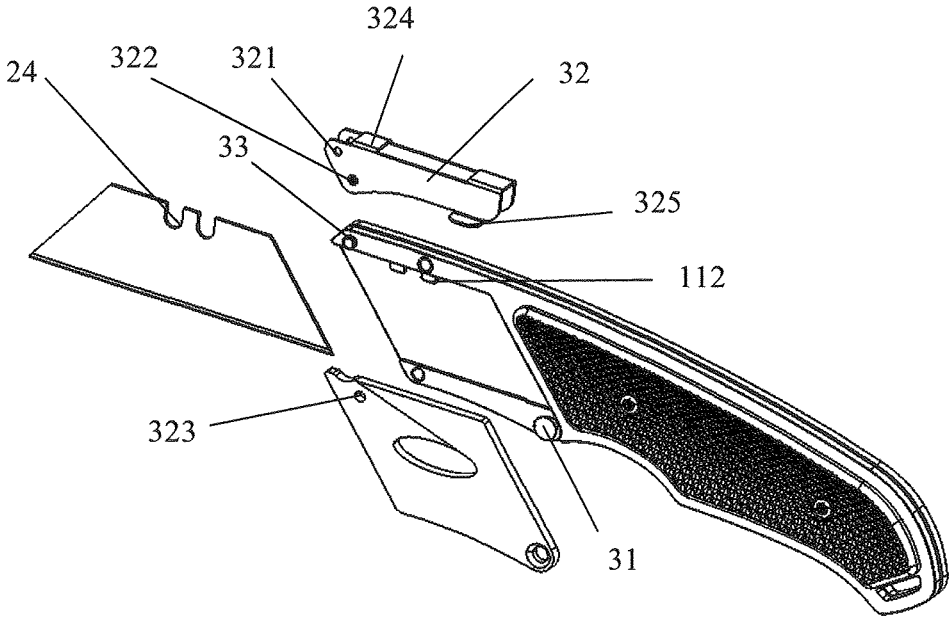
FIG. 4 is a third explosive view of the first embodiment of the present invention.
Figure 5:
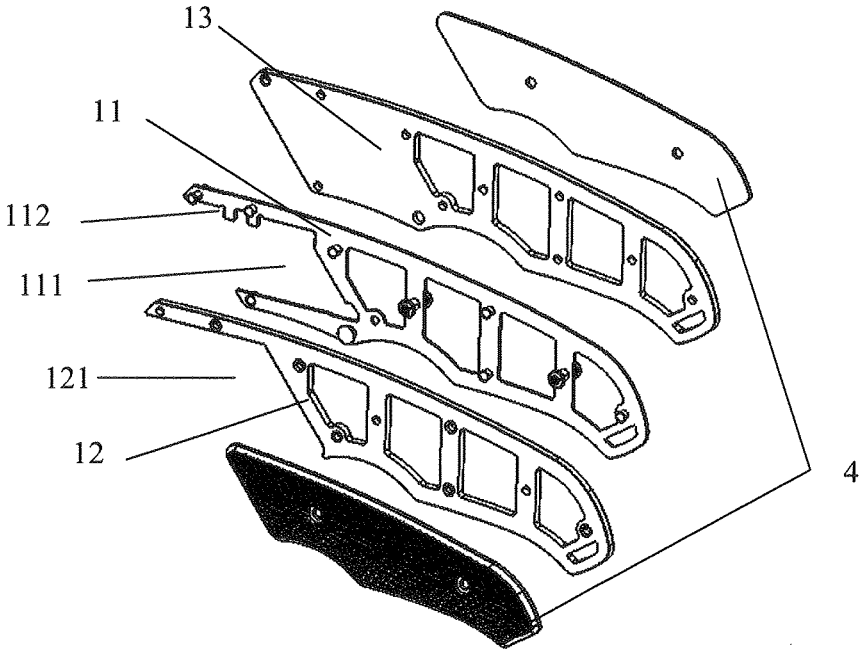
FIG. 5 is a fourth explosive view of the first embodiment of the present invention.
Figure 6:
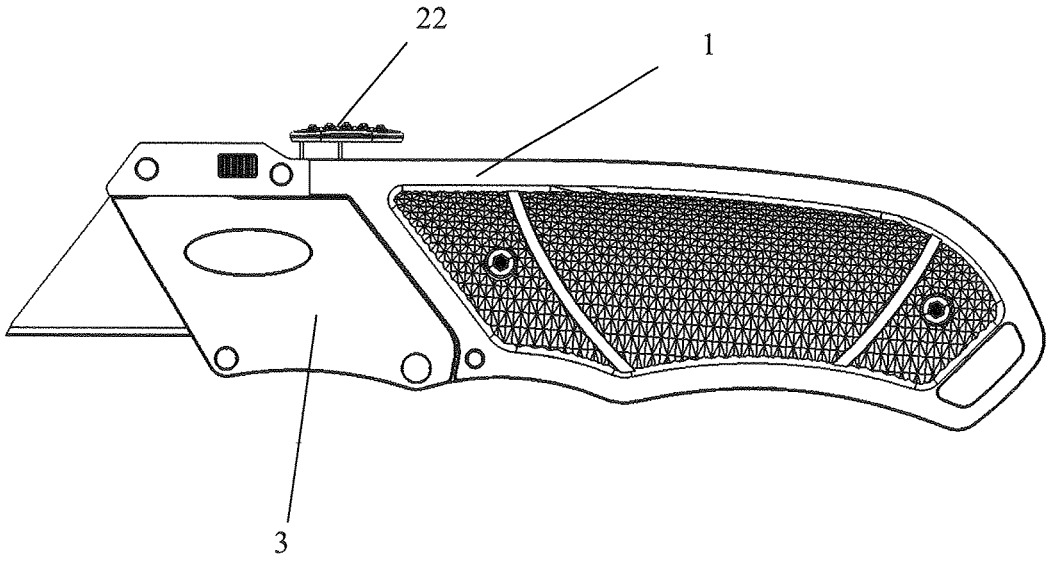
FIG. 6 is a side view of the second embodiment of the present invention.
Figure 7:
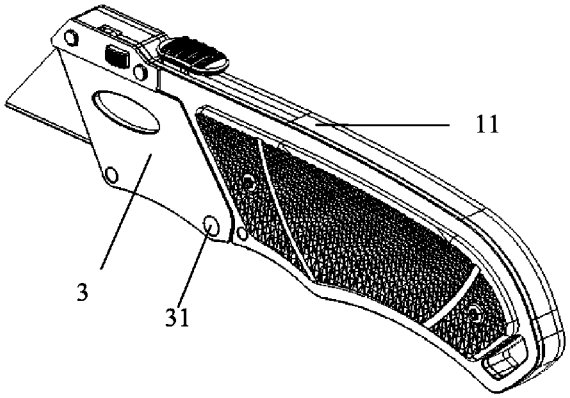
FIG. 7 is a perspective view of the second embodiment of the present invention.
Figure 8:
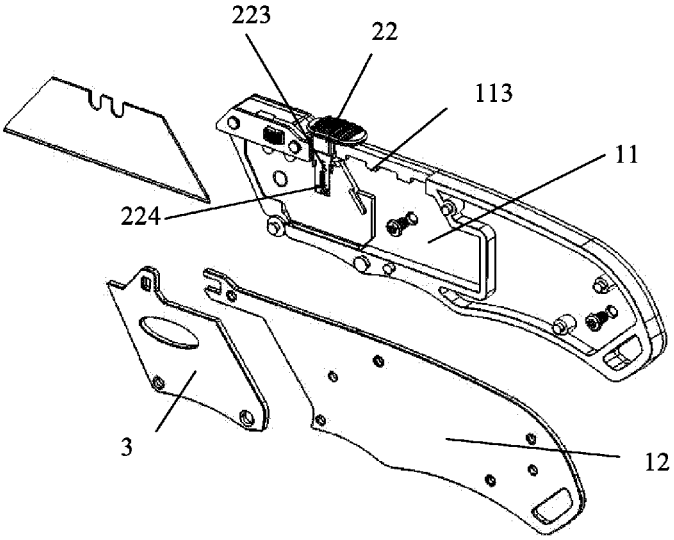
FIG. 8 is a first explosive view of the second embodiment of the present invention.
Figure 9:
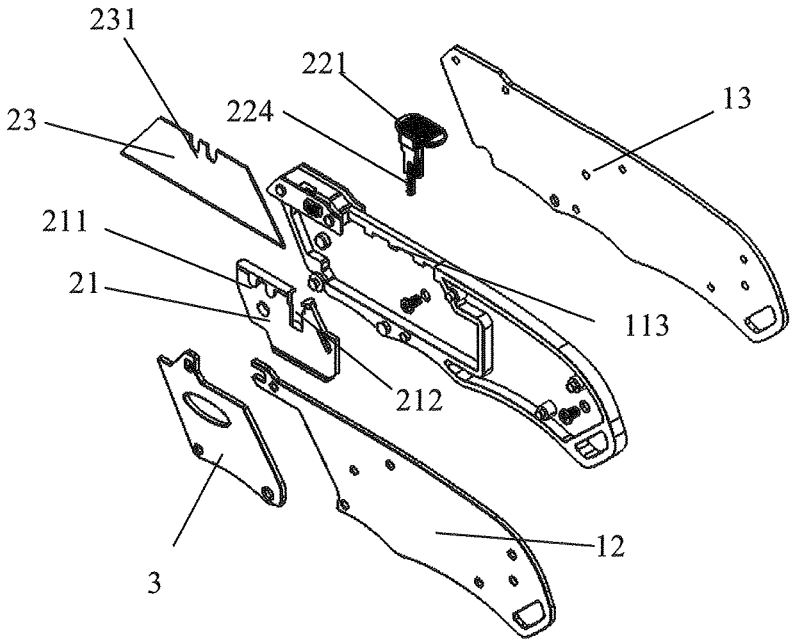
FIG. 9 is a second explosive view of the second embodiment of the present invention.
Figure 10:
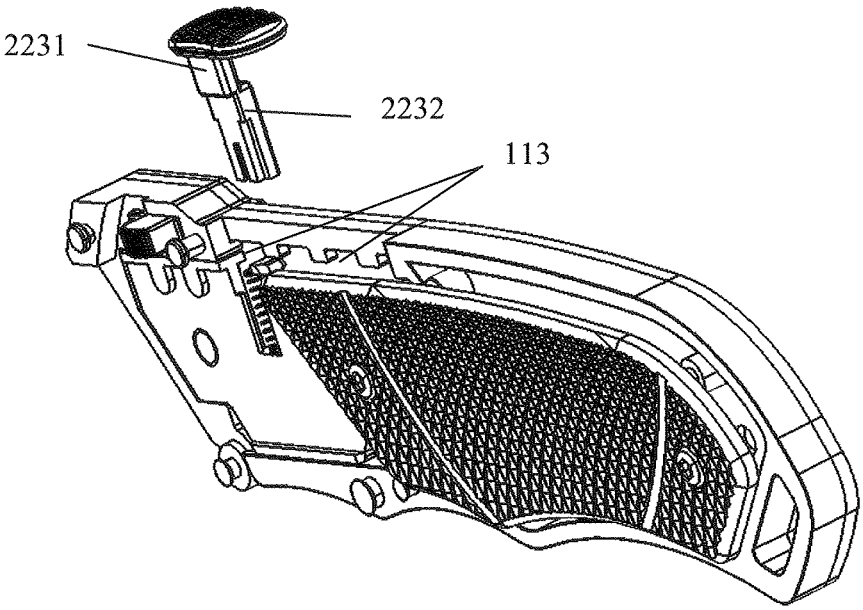
FIG. 10 is a third explosive view of the second embodiment of the present invention.

The cover plate 3 can be connected to the blade carrier 1 in various ways, in the first embodiment as shown in FIG. 3-4, in the second embodiment as shown in FIG. 7-8, a protruding cover plate axis 31 is arranged on the main blade carrier plate 11, the main blade carrier plate 11 is connected to the cover plate via the cover plate axis, the cover plate can rotate around the cover plate axis, when the cover plate rotates out of the location of the blade, the blade in the blade structure can be taken out, accomplishing the purpose of replacing the blade. The cover plate axis can be arranged on the lower edge of the blade structure of the main blade carrier, which is at a side distal from the knife head, the knife head, i.e. the part of the knife that is in use, and the handle which is at the tail of the knife, are at two ends of the utility knife. In this way, the cover plate can rotate downward around the cover plate axis, and expose the blade, in order to accomplish the purpose of replacing the blade.

In the first embodiment, as shown in FIG. 3-4, a lock catch 32 extending to the surface of the cover plate is arranged on the blade carrier, under the working condition when it is not needed to replace the blade, the cover plate and the blade carrier are openably fixed together, ensuring normal use. In the specific embodiment, the lock catch is above the blade carrier, and the lock catch is fixed on the blade carrier via the lock catch axis 33 mounted on the upper edge of the blade carrier above the blade, when it is needed to remove the cover plate, relieve the fixation between the lock catch and the surface of the cover plate, making the lock catch rotate upward around the lock catch axis and leave away from the cover plate, so that the cover plate can rotate downward around the cover plate axis, exposing the blade, and making the blade capable of being replaced. Specifically, the lock catch is of a U-shaped channel structure, holes 321 for installing the lock catch axis are arranged on lateral parts of the U-shaped channel, in this way, the lock catch is mounted on two sides of the blade carrier via the lock catch axis. The width of the U-shaped channel is same as the blade carrier, so when the U-shaped channel buckles the cover plate, the cover plate can cling to the blade carrier stably. A protuberance or a recess 322 is arranged on the side of the U-shaped channel, matched with a recess or a protuberance 323 at the corresponding place on the cover plate. When it is needed to remove the cover plate, exert strength to make the recess and the protuberance mismatch between the U-shaped channel and the cover plate. Lift up the U-shaped channel along the lock catch axis, in this way, the cover plate rotates downward around the axis, and the blade can be taken out. After replacing the blade, the cover plate rotates backward and then buckles the U-shaped channel, making the recess and the protuberance match with each other, and thus fixing the cover plate. The bottom 324 of the U-shaped channel can be a plane, it can also have hollow-out part. At the bottom of the side of the U-shaped channel has a knob 325 transversely extending from the side of the U-shaped channel, which makes it easy to hold by hand and exert force on the U-shaped channel, making the U-shaped channel match or mismatch with the cover plate.

Figure 13:
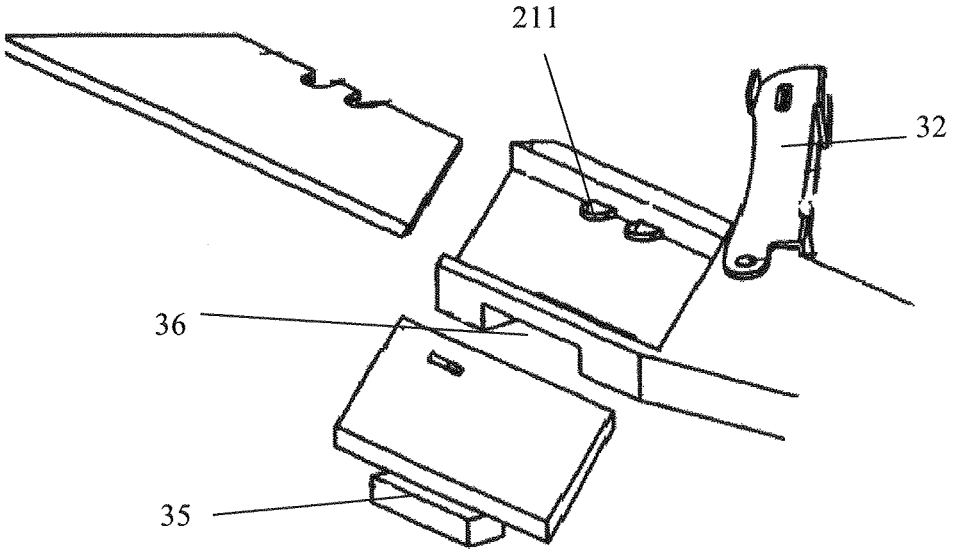
FIG. 13 shows another connection of the cover plate in the present invention.

In the present invention, the cover plate can be fixed on the blade carrier by means of other methods. Such as screw fastening, specifically, the screw fixes the cover plate on the corresponding position of the blade carrier, when the blade needs to be replaced, unscrew the screw, remove the cover plate, and replace the blade. In another example, as shown in FIG. 13 the cover plate and the blade carrier can be connected in a snap-fit structure, specifically, the cover plate 3 has a snap-fit structure 35 at the bottom, the snap-fit structure is a protuberance extending transversely from the side of the bottom of the cover, leaving a corresponding receiving space 36 at the corresponding place of the bottom of the blade carrier, in this way, the cover can be buckled in the receiving space. In this way, when it is needed to replace the blade, lift the protuberance of the cover out of the receiving space with strength, and then take down the cover, and replace the blade. After the blade is replaced, make the protuberance of the cover buckled into the receiving space, fixing the cover on the blade carrier and thus fixing the blade.

Figure 11:
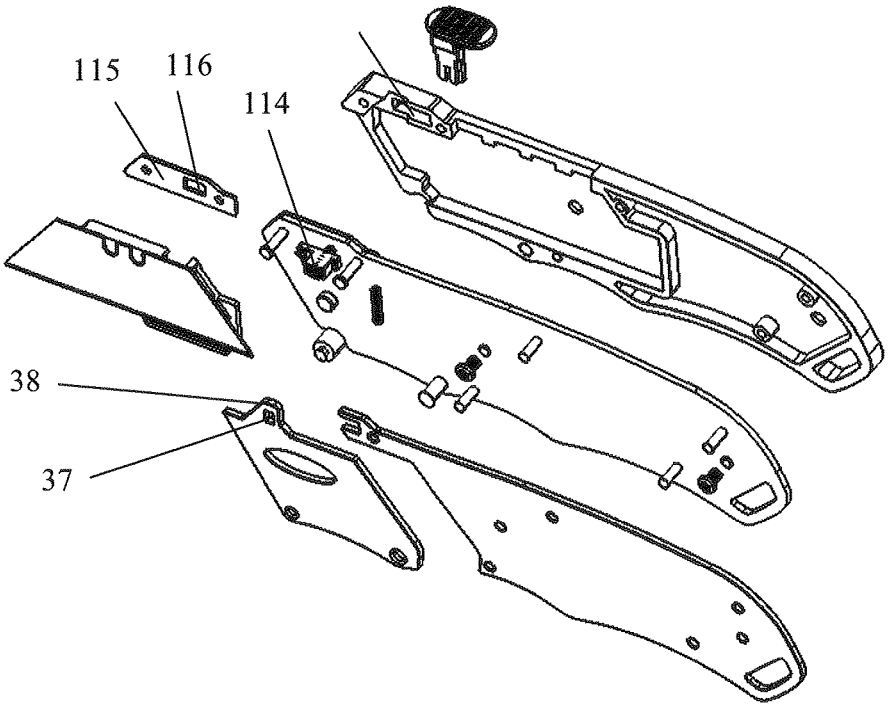
FIG. 11 is a fourth explosive view of the second embodiment of the present invention.
Figure 12:
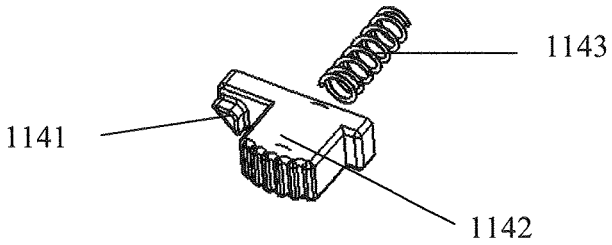
FIG. 12 is a structural schematic view of the fixing part of the second embodiment in the present invention.

In the second embodiment, as shown in FIG. 11, the upside of the cover plate extends to the upper edge of the main blade carrier above the blade structure, the part of the cover plate that is above the blade structure is defined as an extending part 38, a hole 37 is inside of the extending part; a fixing part 114 is located at a place on the main blade carrier that is corresponding to the hole, the fixing part is connected to the main blade carrier plate and the fixing part has a protuberance 1141, the protuberance is matched with the hole and reaches into the hole, and capable of fixing the cover plate 3 on the fixing part. Outside of the cover plate and the fixing part, the blade carrier further includes a position restricting plate 115 which is mounted on the outside of the extending part of the cover plate, restricting the extending part of the cover plate in the position restricting plate, in this way, the cover plate is fixed. The fixing part has a triggering part 1142 which is adjacent to the protuberance, the position restricting plate has a through-hole 116 at the place that is corresponding to the triggering part, the triggering part extends to the outside of the through-hole. It can be touched and operated by hand; the fixing part has a spring element 1143 that is arranged on the other side of the protuberance and the triggering part, the spring element extends to the channel on the main blade carrier plate that is corresponding to the fixing part, in this way, when the triggering part is pressed down, the fixing part is moving towards the channel, making the protuberance of the fixing part separate from the hole on the cover plate, so that when the cover plate is rotated, the cover plate leaves away from the upside of the blade, making it possible to replace the blade.

In the present invention, the overall thickness of the plate-type utility knife is greater than or equals 1 mm, and less than or equals 10 mm. Preferably, the overall thickness of the plate-type utility knife is greater than or equals 3 mm and less than or equals 7 mm. The optimal thickness is 5 mm. Due to the method of using open cover to replace the blade, the structure of the present invention can make the overall thickness of the product thin, making the thin knife body of the utility knife able to perform the cutting operations in narrow and small space. Since the knife body of the existing product is relatively thick, the existing product is bad for or unable to perform such work. At the same time, the thin product further reduces the cost of the product.

In the first embodiment, as shown in FIG. 1-5, the blade structure 2 is the blade itself. Notches 24 are on the back of the blade, for fixing the blade. On the main blade carrier, integrally-formed protuberances 112 is arranged on the place corresponding to the notches of the blade, buckled in the notches, for fixing the blade. Then a cover plate is used to press the blade, making the structure of the utility blade stable. The back blade carrier, for providing back support to the blade, the blade is located between the cover plate and the blade carrier plate to be fixed.

In the second embodiment, as shown in FIG. 6-9, the blade structure is a structure that allows the blade to slide forward and backward, in this way, the main blade carrier is thicker than that in the first embodiment. In this embodiment, the blade structure 2 is comprised of, a sliding blade carrier 21 that can move forward and backward along the blade carrier, a sliding control element 22 extending from the top of the sliding blade carrier to the upside of the outside of the main blade carrier, the blade 23 is mounted on the sliding blade carrier, thus, the extending and retracting of the blade carrier and the blade it carries can be controlled by moving the sliding control element.

The blade has notches 231 on the back thereof, the sliding blade carrier has a protuberances 211 at the place corresponding to the notches of the blade, for fixing the blade. The sliding control element has the grip region 221 which is above the blade carrier, and the control rod 223 which extends from the grip region to the sliding blade carrier. Accordingly, a receiving recess 212 is arranged on top of the sliding blade carrier, for receiving the control rod 223 of the sliding control element. In this way, when moving the control rod by moving the grip region of the control element, the sliding blade will move concomitantly, thus moving the blade mounted on the sliding blade carrier. Further, the spring 224 is arranged between the bottom of the control rod and the receiving recess of the sliding blade carrier. The lower part 2232 of the control rod is a lateral protuberance towards the main blade carrier plate corresponding to the upper part of the control rod 2231, spaced recesses 113 are arranged at the corresponding place on the main blade carrier plate. Normally, when the spring force is not overcome, the lateral protuberance at the lower part of the control rod extends into the recesses on the blade carrier plate, the side wall of the recesses will obstruct the lower part of the control rod, making the control rod incapable of moving. When the grip region of the sliding control element is pressed down, the spring is compressed, the sliding control element can move downward, in this way, the lateral protuberance on the lower part of the control rod moves to the space under the recesses of the main blade carrier plate, incapable of obstructing the sliding of the sliding control element, making the sliding control element capable of driving the blade to move. However, when the sliding control element is not pressed down, the spring generates an upward elastic force, making the lateral protuberance on the lower part of the control rod move to any of the recesses, being obstructed by the recesses in the sliding direction of the sliding control element. In this way, this can prevent the blade from being pushed out by accident and hurting the user. And this also can fix the blade in different positions and be convenient for the user to use.

The ongoing description details the preferable embodiments of the invention. It should be understood that with the general technique of this field, no inventive work is necessary as to make multiple amendments and changes according to conception of this invention. Therefore, all the technical schemes gained from logical analysis, deductions or limited experimentation based on the present invention by technicians in this field, should be considered within the protection range asserted in the Claims.

The invention claimed is:

1. A plate-type utility knife, comprising a blade carrier, a blade structure and a cover plate, wherein, the blade structure is mounted on a front part of the blade carrier, between the blade carrier and the cover plate, and the cover plate can openably fix the blade structure on the blade carrier, wherein, the blade carrier comprises a main blade carrier plate and a front blade carrier plate, and the front blade carrier plate is located in front of the main blade carrier plate; a vacancy that contains the blade structure is arranged on a front side of the main blade carrier plate, and the blade structure is arranged in the vacancy; a space for containing the cover plate is arranged on a front side of the front blade carrier plate, and the cover plate is mounted in the space.

2. The plate-type utility knife as claimed in claim 1, wherein, the blade carrier further comprises a back blade carrier plate, and the main blade carrier plate is located between the front blade carrier plate and the back blade carrier plate.

3. The plate-type utility knife as claimed in claim 2, wherein, the main blade carrier plate, the front blade carrier plate, and the back blade carrier plate are respectively integrally-formed plate structure.

4. The plate-type utility knife as claimed in claim 3, wherein, a protruding cover plate axis is arranged on the main blade carrier plate, the main blade carrier plate is connected with the cover plate via the cover plate axis, and the cover plate is rotatable around the cover plate axis.

5. The plate-type utility knife as claimed in claim 4, wherein, the cover plate axis is arranged on the main blade carrier plate, at a lower edge of the blade structure, distal from a knife head.

6. The plate-type utility knife as claimed in claim 5, wherein, the blade carrier has a lock catch extending to a surface of the cover plate.

7. The plate-type utility knife as claimed in claim 6, wherein, the lock catch is located on a top of the blade carrier, and the lock catch is fixed on the blade carrier via a lock catch axis which is fixed on an upper edge of the blade carrier that is above a blade.

8. The plate-type utility knife as claimed in claim 7, wherein, the lock catch is of a U-shaped channel structure, holes for mounting the lock catch axis are arranged on lateral parts of the U-shaped channel structure, and the lock catch is mounted on opposing two sides of the blade carrier via the lock catch axis.

9. The plate-type utility knife as claimed in claim 8, wherein, the width of the U-shaped channel structure is same as the blade carrier.

10. The plate-type utility knife as claimed in claim 9, wherein, the U-shaped channel structure has a protuberance or a recess on the side that is matched with a recess or a protuberance at the corresponding place on the cover plate.

11. The plate-type utility knife as claimed in claim 10, wherein, the U-shaped channel structure has a handle that extends transversely from the side of the U-shaped channel structure at the bottom of the side of the U-shaped channel structure.

12. The plate-type utility knife as claimed in claim 8, wherein, the blade structure is a blade, the blade has notches on the back thereof, and the main blade carrier plate has integrally-formed protuberances at places corresponding to the notches of the blade, capable of being buckled in the notches.

13. The plate-type utility knife as claimed in claim 5, wherein, an upside of the cover plate extends to the upper edge of the main blade carrier plate above the blade structure, the part of the cover plate that is above the blade structure is defined as an extending part, and a hole is inside of the extending part; a fixing part is located at a place on the main blade carrier plate that is corresponding to the hole, the fixing part is connected to the main blade carrier plate and the fixing part has a protuberance, the protuberance is matched with the hole and reaches into the hole.

14. The plate-type utility knife as claimed in claim 13, wherein, the blade carrier has a position restricting plate that is mounted at an outside of the extending part of the cover plate, making the extending part of the cover plate restrict in the position restricting plate.

15. The plate-type utility knife as claimed in claim 14, wherein, the fixing part has a triggering part which is adjacent to the protuberance, the position restricting plate has a through-hole at a place that is corresponding to the triggering part, and the triggering part extends to an outside of the through-hole; the fixing part has a spring element arranged on one side of the protuberance and the triggering part, and the spring element extends to a channel on the main blade carrier plate which is at a place corresponding to the fixing part.

16. The plate-type utility knife as claimed in claim 5, wherein, the blade structure comprises a sliding blade carrier that can move forward and backward along the blade carrier, a sliding control element that extends from a top of the sliding blade carrier to an upside of an outside of the main blade carrier plate, and a blade which is mounted on the sliding blade carrier, thus, the extending and retracting of the sliding blade carrier and the blade can be controlled by moving the sliding control element.

17. The plate-type utility knife as claimed in claim 16, wherein, the blade has notches on the back thereof, and the sliding blade carrier has protuberances at places corresponding to the notches of the blade, for fixing the blade.

18. The plate-type utility knife as claimed in claim 17, wherein, the sliding control element has a grip region and a control rod, the grip region is above the blade carrier and the control rod extends from the grip region down to the sliding blade carrier; the sliding blade carrier has a receiving recess on an upper part thereof for receiving the control rod of the sliding control element.

19. The plate-type utility knife as claimed in claim 18, wherein, a spring is arranged between a lower part of the control rod and the receiving recess of the sliding blade carrier, the lower part of the control rod is a lateral protuberance towards the main blade carrier plate, the lateral protuberance is corresponding to an upper part of the control rod, and spaced recesses are arranged at corresponding places of the main blade carrier plate.

20. The plate-type utility knife as claimed in claim 3, wherein, the cover plate and the blade carrier can be connected by screw fastening, or in a snap-fit way.

21. The plate-type utility knife as claimed in claim 1, wherein, an overall thickness of the plate-type utility knife is greater than or equals to 1 mm and less than or equals to 10 mm.

22. The plate-type utility knife as claimed in claim 21, wherein, the overall thickness of the plate-type utility knife is greater than or equals to 3 mm and less than or equals to 7 mm.

23. The plate-type utility knife as claimed in claim 22, wherein, the overall thickness of the plate-type utility knife is 5 mm.

* * * * *